US010014168B2

(12) United States Patent
Zhang et al.

(10) Patent No.: US 10,014,168 B2
(45) Date of Patent: Jul. 3, 2018

(54) ION GUIDING DEVICE AND ION GUIDING METHOD

(71) Applicant: SHIMADZU RESEARCH LABORATORY (SHANGHAI) CO., LTD., Shanghai (CN)

(72) Inventors: Xiaoqiang Zhang, Shanghai (CN); Wenjian Sun, Shanghai (CN)

(73) Assignee: SHIMADZU RESEARCH LABORATORY (SHANGHAI) CO., LTD., Shanghai (CN)

( * ) Notice: Subject to any disclaimer, the term of this patent is extended or adjusted under 35 U.S.C. 154(b) by 0 days.

(21) Appl. No.: 14/785,271

(22) PCT Filed: Mar. 26, 2014

(86) PCT No.: PCT/CN2014/074068
§ 371 (c)(1),
(2) Date: Oct. 16, 2015

(87) PCT Pub. No.: WO2014/169754
PCT Pub. Date: Oct. 23, 2014

(65) Prior Publication Data

US 2016/0071714 A1 Mar. 10, 2016

(30) Foreign Application Priority Data

Apr. 18, 2013 (CN) ..... 2013 1 0136304

(51) Int. Cl.
*H01J 49/00* (2006.01)
*H01J 49/06* (2006.01)
*H01J 49/34* (2006.01)

(52) U.S. Cl.
CPC ..... *H01J 49/063* (2013.01); *H01J 49/004* (2013.01); *H01J 49/0031* (2013.01);
(Continued)

(58) Field of Classification Search
CPC .... H01J 49/063; H01J 49/0031; H01J 49/004; H01J 49/062; H01J 49/065; H01J 49/34
(Continued)

(56) References Cited

U.S. PATENT DOCUMENTS

2002/0074492 A1 6/2002 Taniguchi
2009/0173880 A1* 7/2009 Bateman ..... H01J 49/065 250/292
2011/0095175 A1* 4/2011 Bateman ..... G01N 27/624 250/282

FOREIGN PATENT DOCUMENTS

CN 102937622 A 2/2013
JP 3767317 A 4/2006

OTHER PUBLICATIONS

State Intellectual Property Office of the P.R. China (ISR/CN), "International Search Report for PCT/CN2014/074068", China, Jun. 16, 2014.

* cited by examiner

*Primary Examiner* — Wyatt Stoffa
*Assistant Examiner* — Hanway Chang
(74) *Attorney, Agent, or Firm* — Tim Tingkang Xia, Esq.; Locke Lord LLP

(57) ABSTRACT

An ion guiding device (3) and method, the ion guiding device (3) having: a group of electrode arrays distributed along an axis in space, and a power supply providing an asymmetric alternating current (AC) electric field substantially along the axis; the AC field asymmetrically alternates between positive and negative along the axis to drive the ions move in the direction corresponding to said AC electric field such that ions are guided into said ion guiding device (3) in a continuous or quasi-continuous flow manner while being guided out in a pulsed manner along the axis.

37 Claims, 10 Drawing Sheets

(52) U.S. Cl.
CPC ..... *H01J 49/062* (2013.01); *H01J 49/065* (2013.01); *H01J 49/34* (2013.01)

(58) Field of Classification Search
USPC ..... 250/281, 282, 286, 287, 288, 290, 293
See application file for complete search history.

(a)

(b)

(c)

(a)

(b)

(a)

(b)

ION GUIDING DEVICE AND ION GUIDING METHOD

BACKGROUND OF THE PRESENT INVENTION

Field of Invention

The present invention relates to an ion guiding device and an ion guiding method, and particularly relates to an ion guiding device and an ion guiding method in which the ion flow injected is bunched at a certain gas pressure and then ejected in a pulsed manner.

Description of Related Arts

In a mass spectrometer or an ion mobility spectrometer, for an ion analyzer used in a pulsed manner, the required ion flow must be in pulses instead of continuous. For example, for a time-of-flight mass analyzer, the ion flow entering a flight tube must be in pulses to match with an acceleration voltage of pulses. This is the reason why the time-of-flight mass spectrometer is always used together with a pulsed laser desorption ionization source, since the latter one can generate a pulsed ion flow. For the ion mobility spectrometer, it is also required that a pulsed ion flow enters a drift tube to match with a pulsed drift voltage. However, in many cases, the ion flow obtained from an ion source (for example, the most widely used electrospray ion source and electron impact ion source) is continuous or semi-continuous, such ion sources cannot be directly used together with the pulsed ion analyzer, and an ion bunching device is usually necessary to turn the continuous ion flow to a pulsed ion flow. However, the current ion bunching device generally loses sensitivity thereof and requires complicated operation timing, so that a power supply and a control system thereof are complicated as well.

For example, for the time-of-flight mass spectrometer or the ion mobility spectrometer, a conventional ion bunching device is a method proposed by Brenton et al. in "Rapid Commun. Mass Spectrom. 2007; 21: 3093", in which an ion gate is simply disposed, the ion gate is usually in a closed state, and when ion pulses are required, the ion gate is opened rapidly and then closed rapidly, so as to generate a very short ion pulse and eject the ion pulse, this is equivalent to "slice" the ion flow. However, a large amount of ions between two "slices" will be lost by using this method, resulting in reduced sensitivity of instrument.

To improve the utilization of ions as much as possible, it is proposed by Chernushevich in "Eur. J. Mass Spectrom. 2000; 6: 471" and Hashimoto in "J. Am. Soc. Mass Spectrom. 2006; 17: 1669" that a multipole rod applied with a radio frequency (RF) voltage may be used to trap ions temporarily, this method can effectively improve the "duty cycle" of ions being leading to the time-of-flight mass analyzer; however, this method essentially uses an ion gate and still needs to operate the voltage according to certain timing, and a power supply and a control system that are required to be provided are also complicated accordingly.

Further, there are some methods for forming a well-bunched ion packet. For example, the electric field in space where the ion flow is located is divided into several segments for respective configuration, ions are decelerated or reversed in a front segment and accelerated in a post segment, so that ions are adjacent to each other to form an ion pack; or, a deceleration region is disposed at a certain segment through which ions pass, when the ion flow passes through, an electric field of the deceleration region is removed rapidly, such that ions in a front segment of the ion flow are decelerated for a longer time to have a greatly reduced speed, and are caught up by ions in a post segment, so that the ion flow is compressed into a packet. However, these manners have the following obvious defects: for example, not only a high-speed operation timing is required, but also different space potentials need to be disposed, which is complicated in implementation; moreover, these manners all have energy selectivity, and cannot well bunch ions having a relative large incident energy difference; further, these manners all need a high vacuum degree to ensure the stability of an ion optical system, and if the vacuum degree is low, ions colliding with background gas molecules cause the ions' movement in a mobility dependence, and ions having different mobilities will disturb the pulse sequence.

U.S. Pat. No. 6,812,453, proposes an ion guiding device driven by using a traveling wave of a direct current voltage. This device can not only cool and bunch the ion flow in a relative broader gas pressure range into a pulse ion flow, but also obtain a substantial same speed when ions are ejected from the device. However, in this device, voltages of electrodes need to be adjusted separately, and therefore, a circuit and a control system thereof are complicated.

SUMMARY OF THE PRESENT INVENTION

An object of the present invention is to design an ion guiding device and method. The device and method can enable a continuous or semi-continuous ion flow to be cooled and bunched after passing through the device, and goes out as a pulsed ion flow. In this case, a mechanical structure and a circuit required by the device are simple.

In view of the above objects, the ion guiding device according to the present invention comprises: a group of electrode arrays distributed along an axis in space; and a power supply, providing an asymmetric alternating current (AC) field substantially along the axis, wherein the AC field asymmetrically alternates between positive and negative along the axis to drive the ions move in the direction corresponding to said AC electric field, such that ions are guided into said ion guiding device in a continuous or quasi-continuous flow manner while being guided out in a pulsed manner along the axis. For example, when an integral value of the field intensity of the AC field to time in each AC period is positive, the positive ion flow ejects from the ion guiding device in pulses.

The ion guiding method according to the present invention comprises: providing a group of electrode arrays distributed along an axis in space; and providing an asymmetric AC field substantially along the axis, wherein the AC field asymmetrically alternates between positive and negative along the axis to drive the ions move in the direction corresponding to said AC electric field, such that ions are guided into said ion guiding device in a continuous or quasi-continuous flow manner while being guided out in a pulsed manner along the axis. For example, when an integral value of the field intensity of the AC field to time in each AC period is positive, the positive ion flow ejects in pulses.

In the ion guiding device and method according to the present invention, continuous or semi-continuous ion flow is bunched after passing through the device, and ejects from the device after being converted into a pulsed ion flow.

Compared with the prior art, the present invention has the following advantages:

1. The electrode configuration, the power supply system and the control system of the device are very simple;

2. The pulse width and pulse interval of the pulsed ion flow may be easily adjusted, the adjustment method is simple, and the adjustment range is broad;

3. The present invention can be widely applied in various equipments and devices such as an ion bunching device, an ion guiding device, a mobility analyzer, and a collision cell.

4. The present invention can be applied in a gas pressure widely ranging from $10^{-2}$ Pa to $10^{5}$ Pa, and has many types of applicable background gas.

BRIEF DESCRIPTION OF THE DRAWINGS

In order that the above objectives, features and advantages of the present invention are more comprehensible, specific embodiments of the present invention are described in detail through accompanying drawings as follows, wherein.

DETAILED DESCRIPTION OF THE PREFERRED EMBODIMENTS

Figure 1:
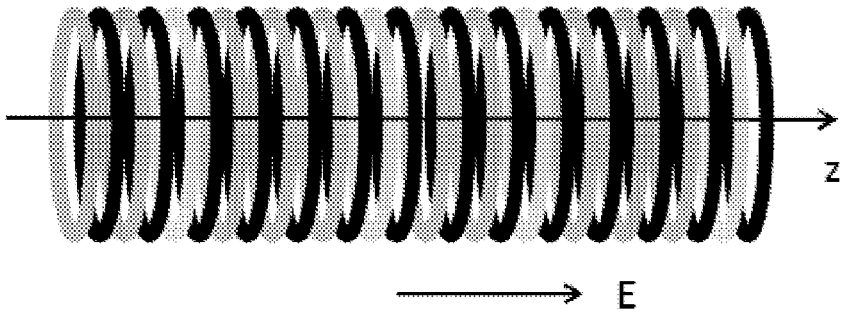
FIG. 1 is a structural and principle diagram of a first embodiment of major constituents of an ion guiding device according to the present invention, wherein (a) is a diagram of an electrode array of the ion guiding device, (b) is a schematic diagram of trajectories of ions in an axis direction, and (c) is a schematic diagram of an electric field changing along with time.
Figure 1:
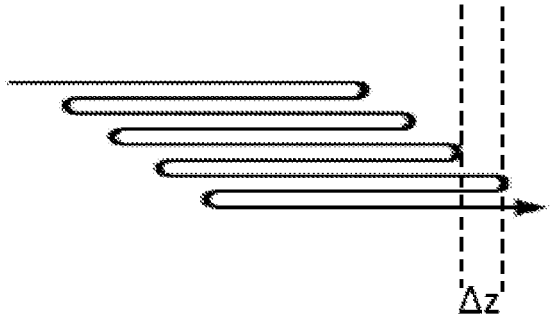
Figure 1:
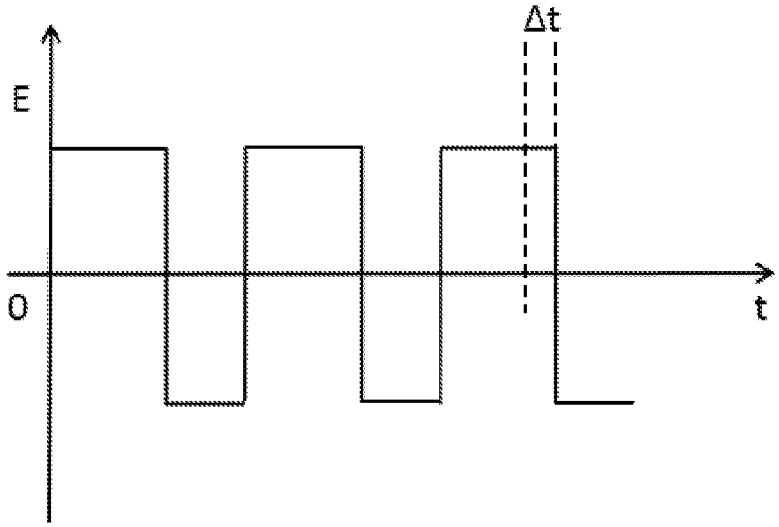

FIG. 1(*a*) is shown to a schematic diagram of a first embodiment of an ion guiding device according to the present invention. The number of electrodes in the electrode array is greater than or equal to 2, and the electrode array is formed by a plurality of ring electrodes distributed along an axis (set to a z axis). The axis is, for example, nonlinear. A voltage is applied to each ring, so as to form an asymmetric AC field distribution shown in FIG. 1(*c*) inside the stacked-ring. The so-called asymmetric AC field refers to that an integral value of the field intensity thereof to time in each AC period is not 0. For example, in an AC field, the field intensity of a positive electric field (set to an electric field along a positive direction of the z axis) and the field intensity of a negative electric field (set to an electric field along a negative direction of the z axis) are the same, but a duration of the positive electric field is different from a duration of the negative electric field; or, in an AC field, the positive electric field and the negative electric field have different intensities but durations thereof are the same, and the like. The AC field in this embodiment is an asymmetric square wave, and in each period, the intensity of the positive electric field (set to an electric field along a positive direction of the z axis) and the field intensity of a negative electric field (set to an electric field along a negative direction of the z axis) are the same, but a duration of the positive electric field is slightly longer than a duration of the negative electric field, that is, a duty cycle of the square wave is slightly greater than 50%. In this case, an integral value of the electric field intensity to time in each AC period is positive. Therefore, in a relatively high gas pressure, ions will behave mobility dependence under the combined effects of the electric field and background gas, that is, the velocity magnitude of the ions is in direct proportion to the electric field intensity. Therefore, ions entering the stacked-ring electrodes, which are positive ions in this embodiment, will move back and forth under the action of the asymmetric square wave; however, the integral value of the positive electric field to time is greater than the integral value of the negative electric field to time, and therefore, the ions substantially drift towards the positive direction, that is, assuming a trajectory shown in FIG. 1(*b*) in the z axial direction. If a detector is disposed at the end of the stacked-ring electrodes, it may be found that ions that originally enters continuously are compressed and bunched after passing through the electrode array, and ejects in a pulsed manner. This is because ions have a "forward and turn around" motion characteristic, and because the duty cycle of the AC field is slightly greater than 50%, for example, 55%, the ions move forward by merely a small distance in each period, that is, $\Delta z$ in FIG. 1(*b*), and ions possibly reach the detector to be detected only at the end of each positive electric field period, that is the $\Delta t$ time period in FIG. 1(*c*). Therefore, the ion flow that is originally ejected continuously is compressed after passing through the device, and then is ejected in pulses within $\Delta t$, that is, the ions are bunched. Therefore, an interval between two adjacent ion pulses is a period of the AC field. The extent of compressing the ions (which is equivalent to the pulse width) depends on setting of $\Delta t$, that is, depends on how the duty cycle of the square wave is close to 50%. Therefore, the pulse width and the pulse interval of ions may be arbitrarily adjusted as long as a proper electric field waveform is applied and the period and duty cycle of the electric field are set.

The above case is described with respect to positive ions, and the case is just the opposite for negative ions. For example, an applied asymmetric AC field needs to meet that an integral value of the electric field intensity to time is less than 0, and the negative ions may eject in a manner of pulse ion flow.

In the first embodiment, the electronic circuit configuration is very simple. A low-frequency AC field is used where the frequency is generally not greater than dozens of kilohertz, and the amplitude thereof is very low which is typically dozens of volts or hundreds of volts; therefore, it is only needed to provide a direct current source and a low-speed digital switch, and potential gradients on the stacked-ring electrode array may be simply implemented by using a series of voltage-dividing resistors, without the need of any real-time timing control.

Figure 2:
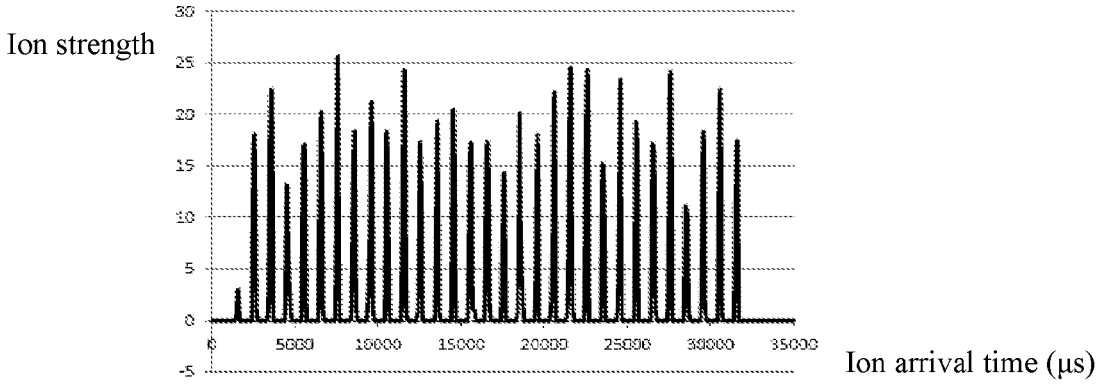
FIG. 2 is a computer simulation result of the first embodiment of the present invention, wherein (a) is a case in a higher gas pressure (100 Pa), and (b) is a case in a lower gas pressure (1 Pa).
Figure 2:
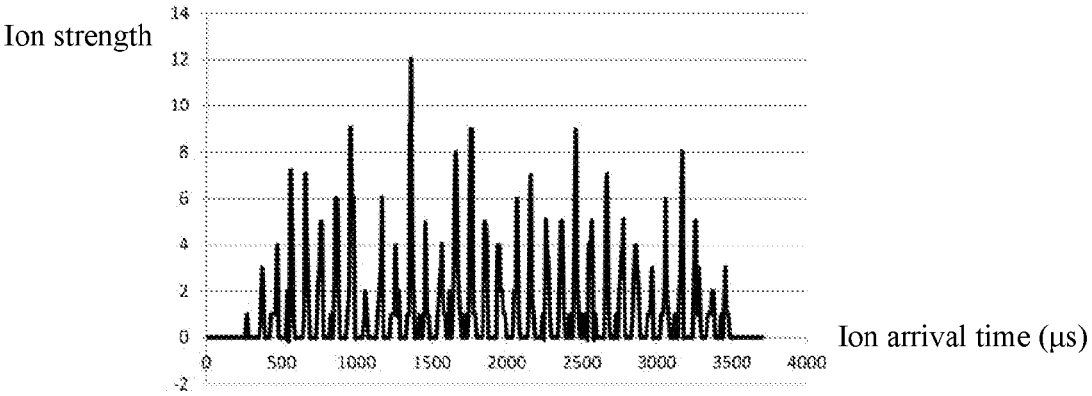

FIG. 2 is a computer simulation result on the ion flow under different gas pressures by using the first embodiment of the present invention, wherein FIG. 2(*a*) is a case at the gas pressure of 100 Pa, and this gas pressure is applicable for ion mobility analysis. During simulation, a large amount of ions continuously get into the device within 30 ms, where a horizontal axis represents the time of ions arriving the detector, and a vertical axis represents the ion intensity. Generally, analysis time of a mobility spectrum (that is, the time passing through a drift tube) is in the order of milliseconds, and therefore, the period of the AC field is set to 1 ms. It can be seen from the result in the figure that, the time of ions arriving the detection is pulsed, an interval between two pulses is 1 ms, and the width of the pulse is about 0.1 ms, thereby implementing effective bunching of ions. FIG. 2(*b*) is a case when the gas pressure is 1 Pa, and the ions can still be well bunched. In the figure, an interval between ion pulses is 100 microseconds, the pulse width is about 10 microseconds, and such gas pressure and pulse interval are generally applicable for analysis of a time-of-flight mass spectrum. The gas pressure range applicable to the device is generally in a range in which ions behave strong mobility dependence, for example, from 0.1 Pa to the atmospheric pressure. For a lower gas pressure, for example, $10^{-2}$ Pa, few collisions occur for ions and the background gas, the mobility dependence is non-obvious. If a better bunching effect is required in that case, it needs to modulate a phase of the AC field at which the ions entering the device, so that most ions incident at substantially the same phase. In addition, the simulation result shows that, for different types of background gas, such as the air, the helium gas and the argon gas, the device and the method also have good bunching effects. In the embodiment, in order to reduce transmission loss of ions in the device, RF voltages having opposite phases commonly are applied to adjacent circular electrodes to bind ions radially.

Figure 3:
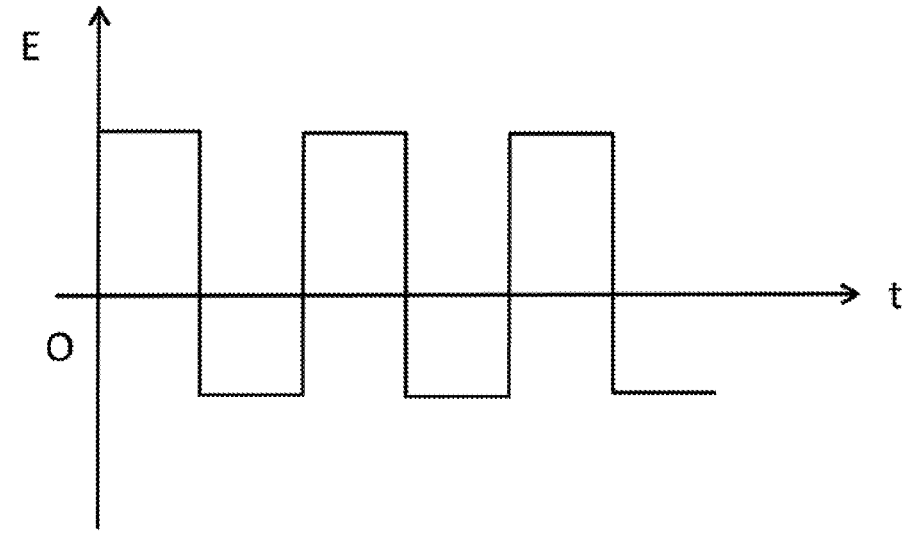
FIG. 3 is a schematic diagram of variations of an asymmetric AC field in the first embodiment of the present invention, wherein (a) is a square wave, and (b) is a sine wave.
Figure 3:
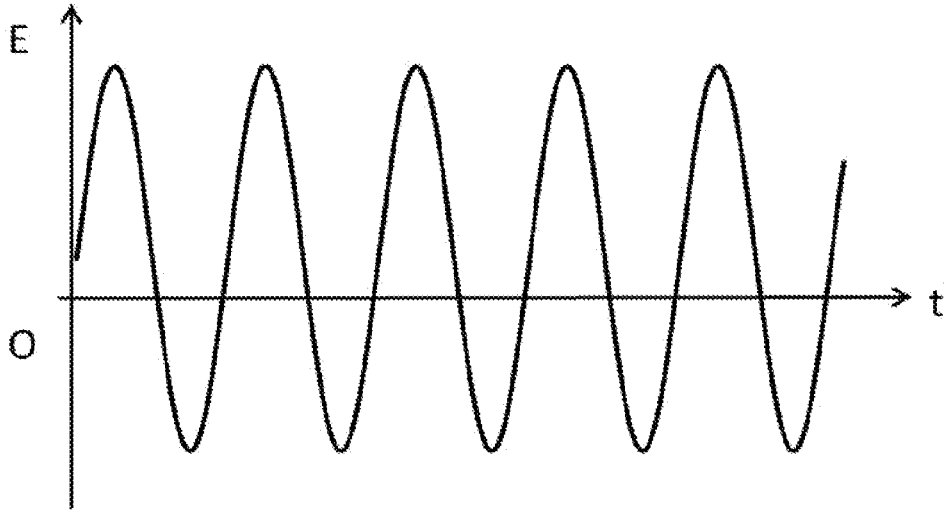

FIG. 3 is a variation of the first embodiment of the present invention, and the variation provides more embodiments of the asymmetric AC field. As shown in FIG. 3(*a*), positive and negative electric fields of the AC square wave use a duty cycle of 50%, but the amplitude of the positive electric field is slightly higher than that of the negative electric field, so an integral value of the whole square wave field intensity to time is still greater than 0, and forward movement of ions on the basis of "forward and turn around" motion can still be implemented; therefore, the similar bunching effect can be achieved. The electric field may also use other waveforms, for example, a sine wave shown in FIG. 3(*b*), and may also use a zigzag wave, a triangular wave, or a combination of various waveforms. For a case requiring emitting positive ions, it is only needed to ensure that an integral value of the field intensity to time in each period of the waveform is a positive value, and it is opposite for a case requiring emitting negative ions. In addition, the waveform may also be changed in time, for example, in a certain time period, it is a periodic symmetric waveform, and in the next period, it is the asymmetric waveform; or the waveform is changed at different positions of the array, for example, it is a symmetric waveform or a linear electric field waveform at a certain position, and it is the asymmetric waveform at another position.

Figure 4:
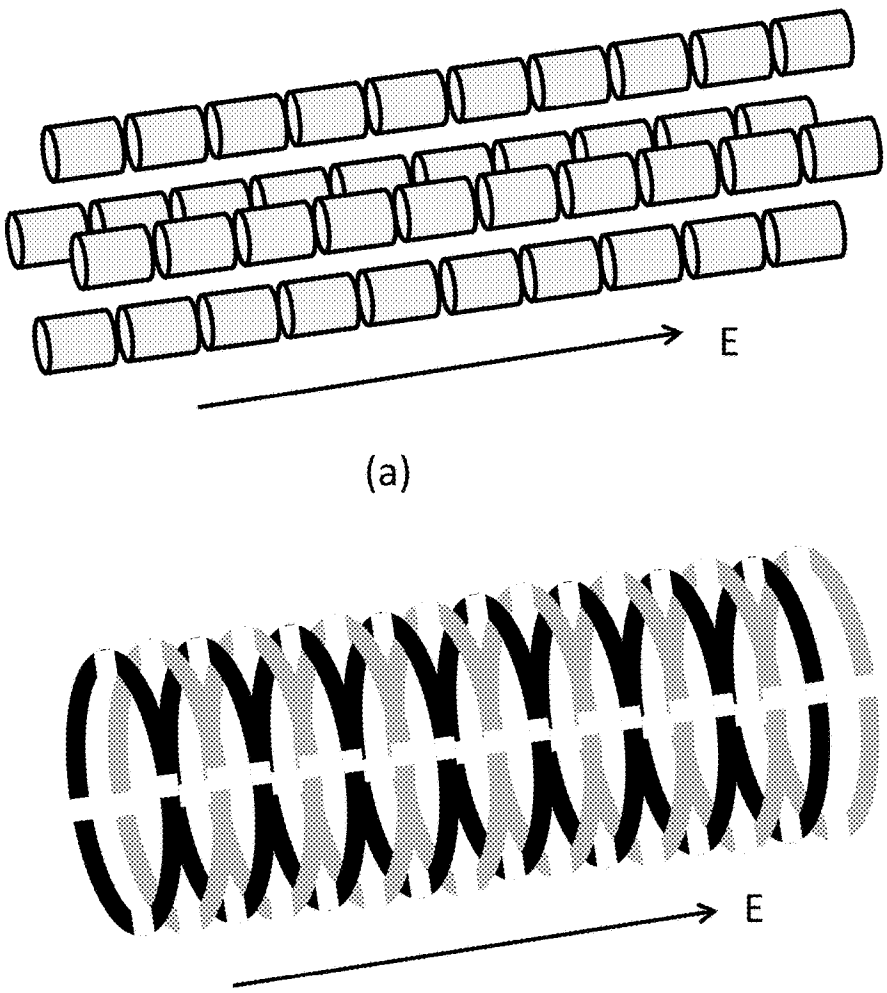
FIG. 4 is a schematic diagram of a second embodiment of major constituents of an ion guiding device according to the present invention, wherein (a) is a schematic diagram of a segmented quadrupole rods configuration, and (b) is a schematic diagram of a stacked-ring electrodes configuration.

FIG. 4 is a second embodiment of the present invention. This embodiment shows that various forms of electrode arrays may be used. For example, a segmented quadrupole rods shown in FIG. 4(*a*) is used, an asymmetric AC field application manner similar to that in the first embodiment is still used, and ion bunching can still be implemented. In addition to the quadrupole rods, other multipole rods, such as a hexapole, an octopole or a higher-order multipole, are available as long as a substantial multipole field (that is, an electric field whose major component is a multipole field) may be generated. Compared with the stacked-ring electrodes, using the multipole rods can obtain a better ion focusing effect, but meanwhile may have some mass discrimination effects. Here, the multipole rod is segmented for ease of applying an axial AC field, and if a suitable technique is used, for example, coating a resistive film on a part of length of the rod and applying an AC field at two ends of the film, and the like, i.e., a single multipole rod, instead of the segmented array, may be used to simplify the structure. In the simplest case, two front and rear plates may be used as electrodes, holes are opened on the plates to serve as an ion inlet and an ion outlet respectively, and at the same, the AC field is applied between the plates, ions may also be bunched; however, in this case, it is difficult to keep a high transmission efficiency.

FIG. 4(*b*) provides a structure of a stacked-ring with radially segmented electrodes, and this structure may have a more flexible electric field application manner. For example, the AC field and the RF electric field are applied according to the method in the first embodiment, but a direct current bias is superimposed between different segments of each ring, so that ions may be guided to one side of the ring in the radial direction, which is equivalent to implementing focusing while bunching the ions, and no mass discrimination occurs.

Figure 5:
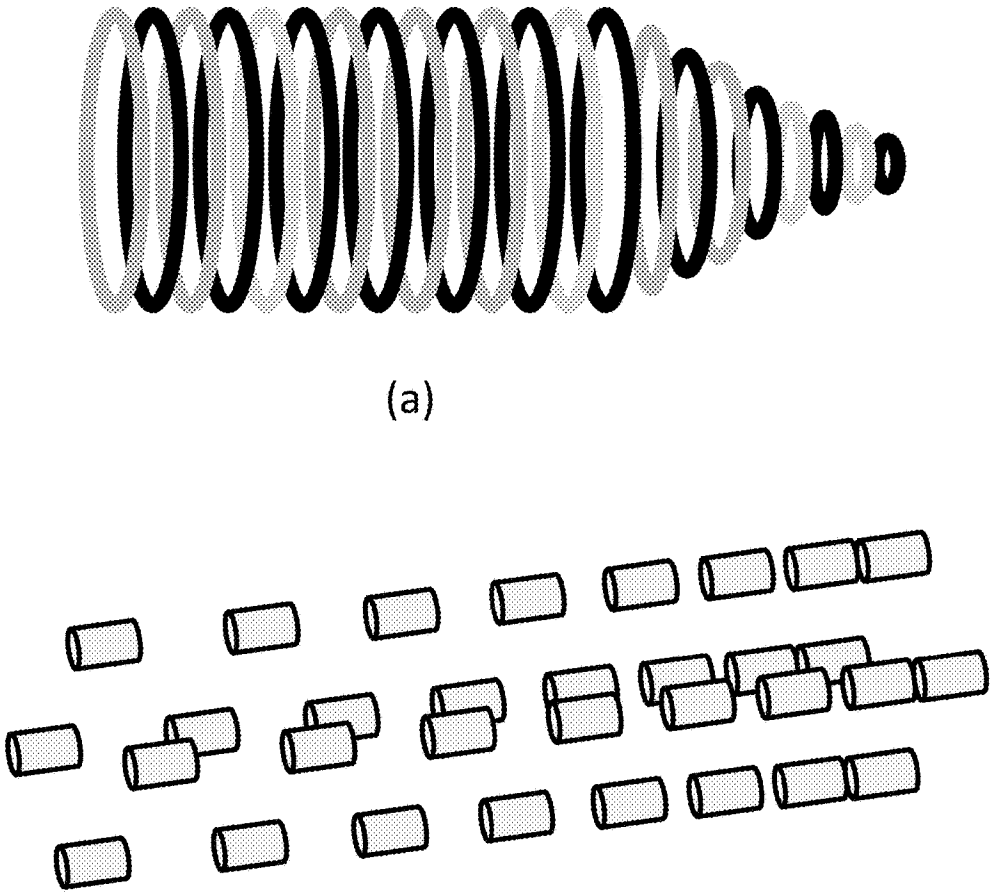
FIG. 5 is a schematic diagram of a variation of the second embodiment of major constituents of an ion guiding device according to the present invention, wherein (a) is a schematic diagram of a stacked-ring electrodes configuration, and (b) is a schematic diagram of a multipole rods configuration.

FIG. 5 is a variation of the second embodiment of the present invention. The variation indicates that the field radius, the distance between adjacent electrodes and other parameters of the electrode array are variable. The appearance of the device of FIG. 5(*a*) is substantially the same as an ion funnel in U.S. Pat. No. 6,107,628, in which part of the device are ring electrodes with gradually reduced radius, and such a structure can achieve good ion focusing; however, in the ion funnel, a constant direct current field is used in the axial direction to push ions forward. In this variation, an asymmetric AC field is used, thereby implementing ion bunching while focusing. Likewise, the radius-variable stacked-ring may also be replaced with the multipole rods. FIG. 5(*b*) uses a segmented quadrupole array whose field radius gradually varies, and this manner is generally used to form a specific RF electric field to meet requirements.

Figure 6:
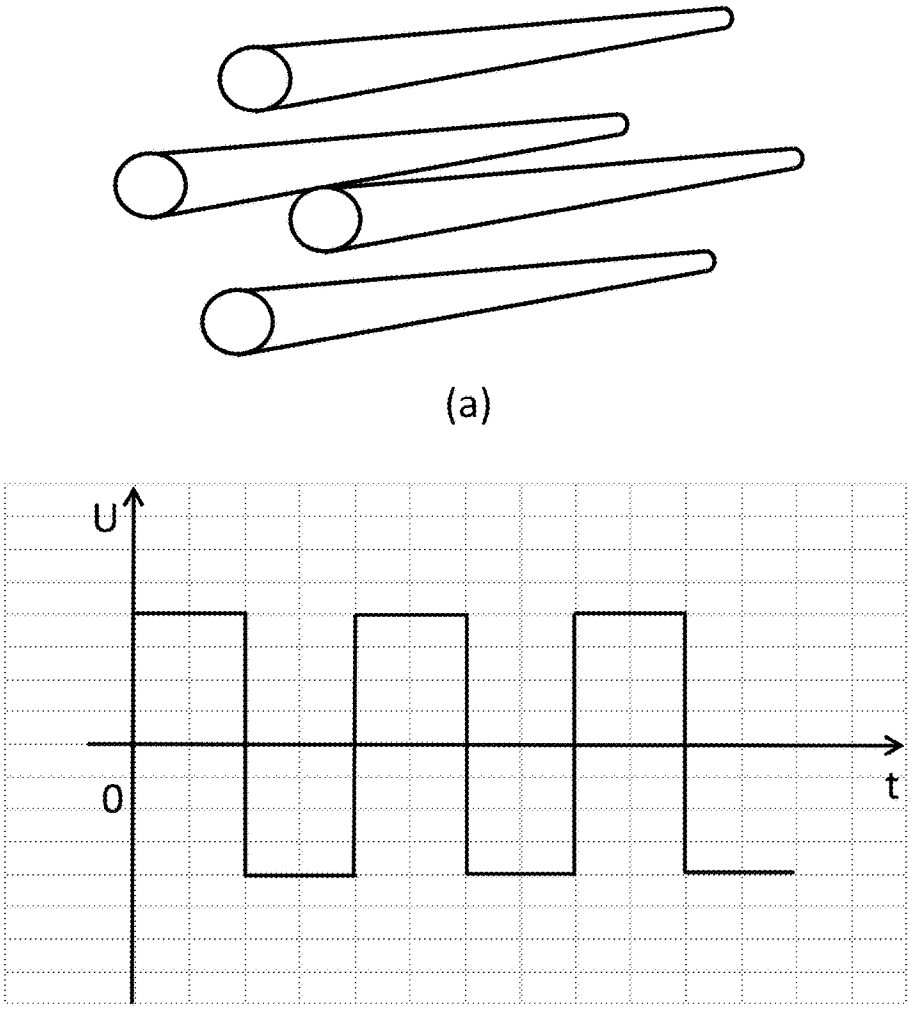
FIG. 6 is a schematic diagram of a third embodiment of the present invention, wherein (a) is a schematic structural diagram, and (b) is a schematic diagram of an applied voltage changing along with time.

FIG. 6 is a third embodiment of the present invention. The embodiment indicates that an applied axial AC field may be a non-uniform field, or a uniform AC field superimposed with an axial electric field. In this case, the application manner of the AC voltage is greatly expanded. For example, a quadrupole that is shown in FIG. 6(*a*) is used, and the rod radius of the rods decreases along the axis, and if a positive potential is applied to the rod, the potential at the center of the rods will gradually decrease along the positive direction of the axis; therefore, a symmetric AC field shown in FIG. 6(*b*) may be used, during the "forward and turn around" motion, ions may still be pushed forward by the potential gradient at the center of the quadrupole rods, and the symmetric AC field makes the electronics very simple. Particularly, if a RF voltage is applied to the quadrupole, the RF voltage may also form a pseudo-potential gradient, and this gradient also enables the ions move forward. Therefore, axial movement and bunching of position ions may be implemented even an asymmetric AC field whose integral value of field intensity to time is less than 0 is used. There are many manners used for providing a direct current electric field in an axial direction, such as adding the auxiliary electrodes, or adding end cap electrodes, or using an asymmetric electrode structure. As another example shown, by using the manner in FIG. 5(*b*), providing of a direction current electric field or a RF potential gradient in an axial direction may be easily implemented. In brief, no matter how the electric field or electrode structure is, it falls within the protection scope of the present invention, as long as an axial AC field is applied and ions are driven to move in the axial direction on the basis of the "forward and turn around" motion is implemented.

Figure 7:
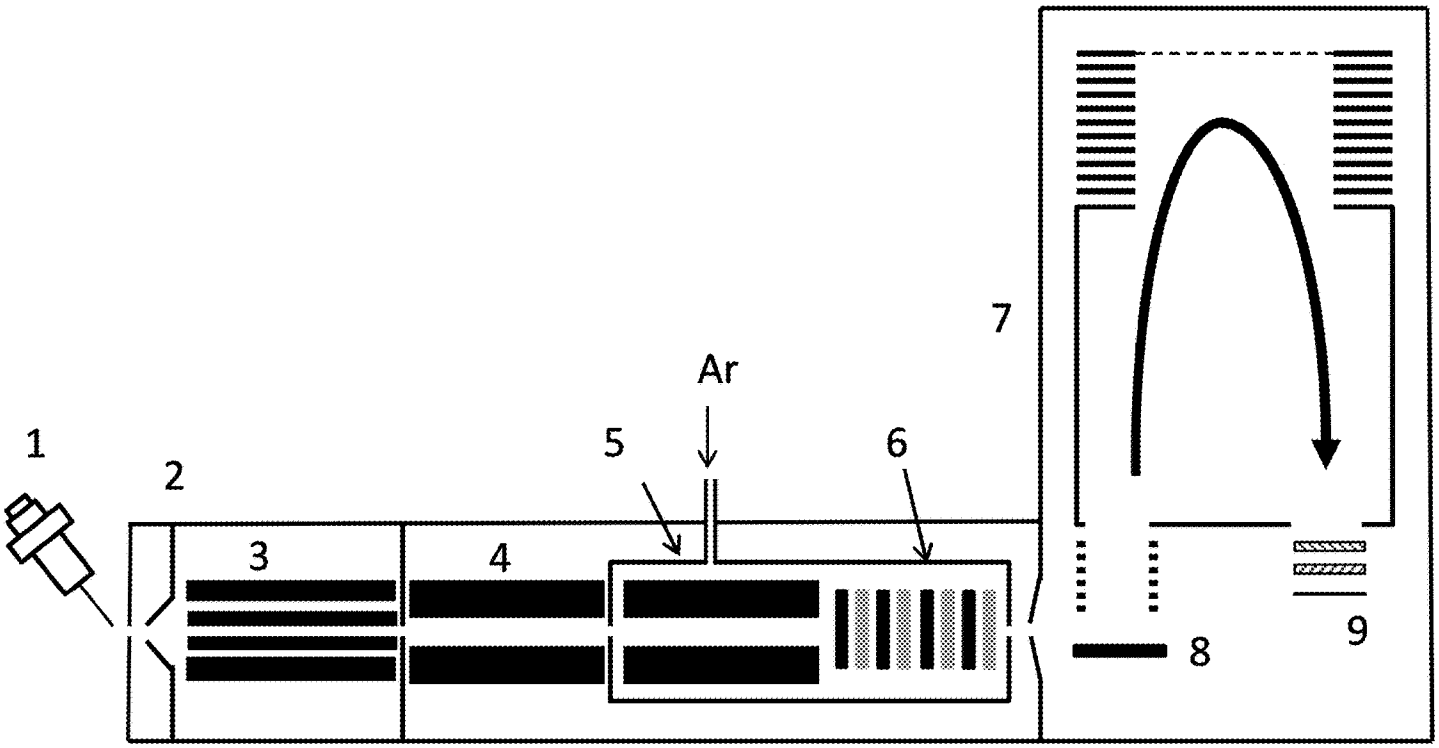
FIG. 7 is a schematic diagram of a first application example of an embodiment of the present invention.

FIG. 7 is an application example of an embodiment of the present invention. FIG. 7 is a typical orthogonal quadrupole time-of-flight mass spectrometer, and the device of the present invention is placed after a collision cell, to serve as a bunching device of ions before entering the time-of-flight mass spectrometer. In a typical analysis process, ions are generated from an ion source 1, pass through an atmosphere interface 2 and an ion guiding device 3, and enter a first quadrupole 4 as a continuous ion flow. Parent ions are selected by the quadrupole, and enter a collision cell 5 to be fragmented to generate various daughter ions. The daughter ion flow passes through the device 6 of the present invention, and is bunched into a pulsed ion flow. A typical gas pressure of the collision cell is several mtorr, and therefore, an initial velocity of the ion flow getting into the device of present invention is very small. Those daughter ions will have basically the same initial velocity when leaving the device. The frequency of a repulsion electrode 8 before a flight tube 7 is matched with the pulse frequency of the daughter ion flow, so that almost 100% ions are received by a detector 9. If not using the device according to the present invention, generally, there are at most about 20% ions can be detected.

In the above application example, the time-of-flight mass spectrometer may be orthogonal, and may also be linear. Moreover, in addition to the time-of-flight mass spectrometer, other mass spectrometers may also be used together with the device as long as a pulsed ion flow is required. For example, the device may be used as a upstream device of an ion trap mass spectrometer or a Fourier transform-type mass spectrometer (such as a cyclotron resonance mass spectrometer and an orbitrap mass spectrometer), ions are bunched before entering the analyzer, so as to improve the duty cycle of analysis or improving the injection efficiency.

Figure 8:
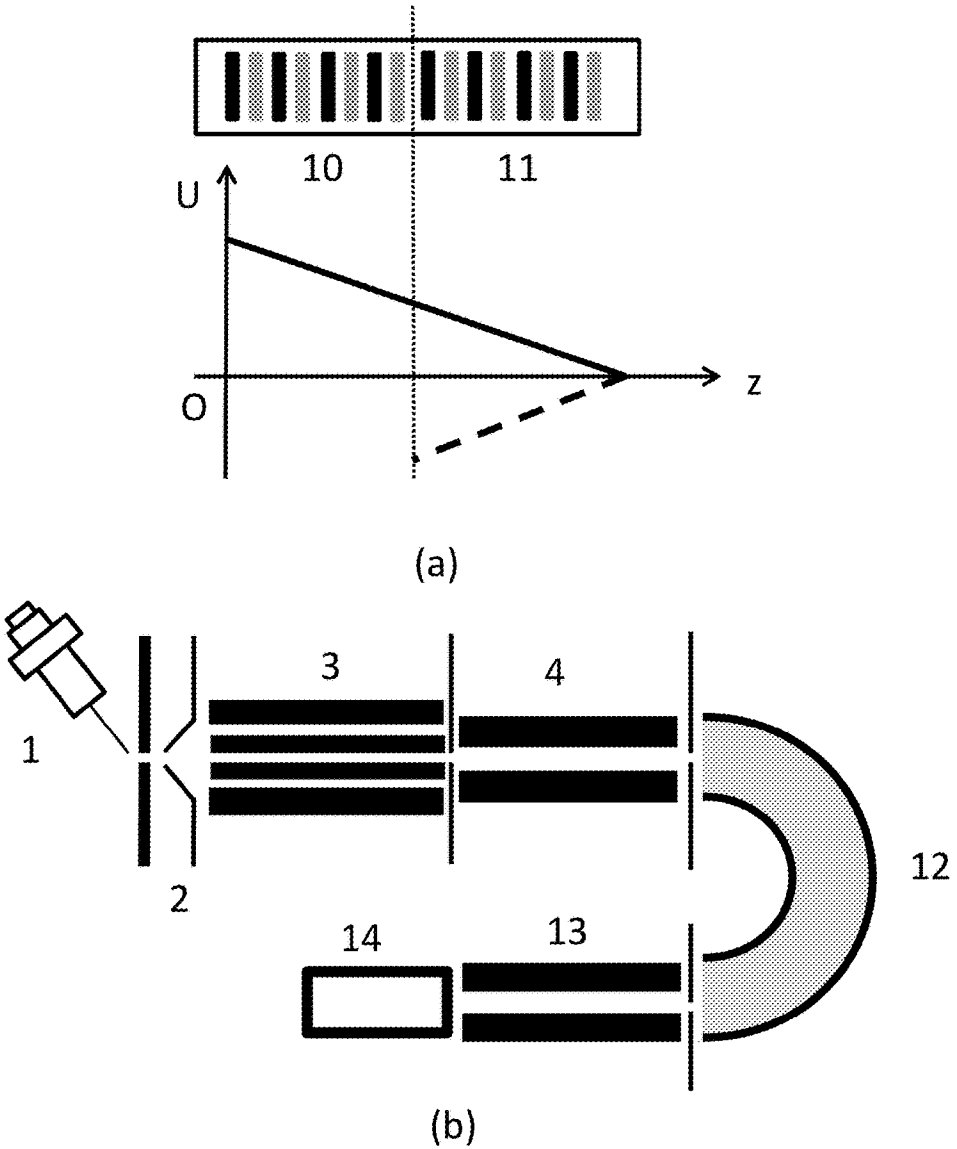
FIG. 8 is (a) a schematic diagram of a second application example of an embodiment of the present invention, and (b) a variation of the application example.

FIG. 8 provides a second application example of an embodiment of the present invention, and in this example, the device may be directly used as a collision cell. In this case, the device may be divided into two segments 10 and 11, as shown in FIG. 8(*a*). The application way of electric fields is also shown in the figure. A direct current electric field with unchanged direction is applied to the segment 10, and an asymmetric AC field is applied to the segment 11. In the figure, a U-z dashed line indicates a potential distribution when the AC field is in a negative value, and a solid line indicates a distribution in a positive value. In this way, ions may be fragmented at the segment 10, and then bunched at the segment 11, and thereby being ready for the mass analyzing by the time-of-flight mass spectrometer or another mass spectrometer. Using the device as the collision cell has additional advantage, that is, a travelling path of ions in the collision cell is increased, thereby improving the dissociation efficiency. If with the same dissociation efficiency, a shorter collision cell may be used, thereby shortening the instrument size. Moreover, a curved structure 12 shown in FIG. 8(*b*) may be used to further shorten the instrument size, thereby benefit to minimization and portability of the instrument. FIG. 8(*b*) further indicates that, although the downstream of the device matching with the pulsed mass analyzer can improve the duty cycle in analysis, it is also possible to use a quadrupole-type "continuous" mass analyzer 13 and a detector 14 in the figure. In this case, it is only required to match the timing between scanning in the quadrupole 13 and the ejecting of pulsed ions from the collision cell 12. Moreover, if the concept of the collision cell is expanded to collision on droplets generated by electrospray ionization, that is, when the device is placed at downstream of an electrospray ion source, travelling paths of sprayed droplets or ion clusters may be increased, thereby giving higher desolvation efficiency and de-clustering efficiency, and increasing the number of ions entering the post stage.

Figure 9:
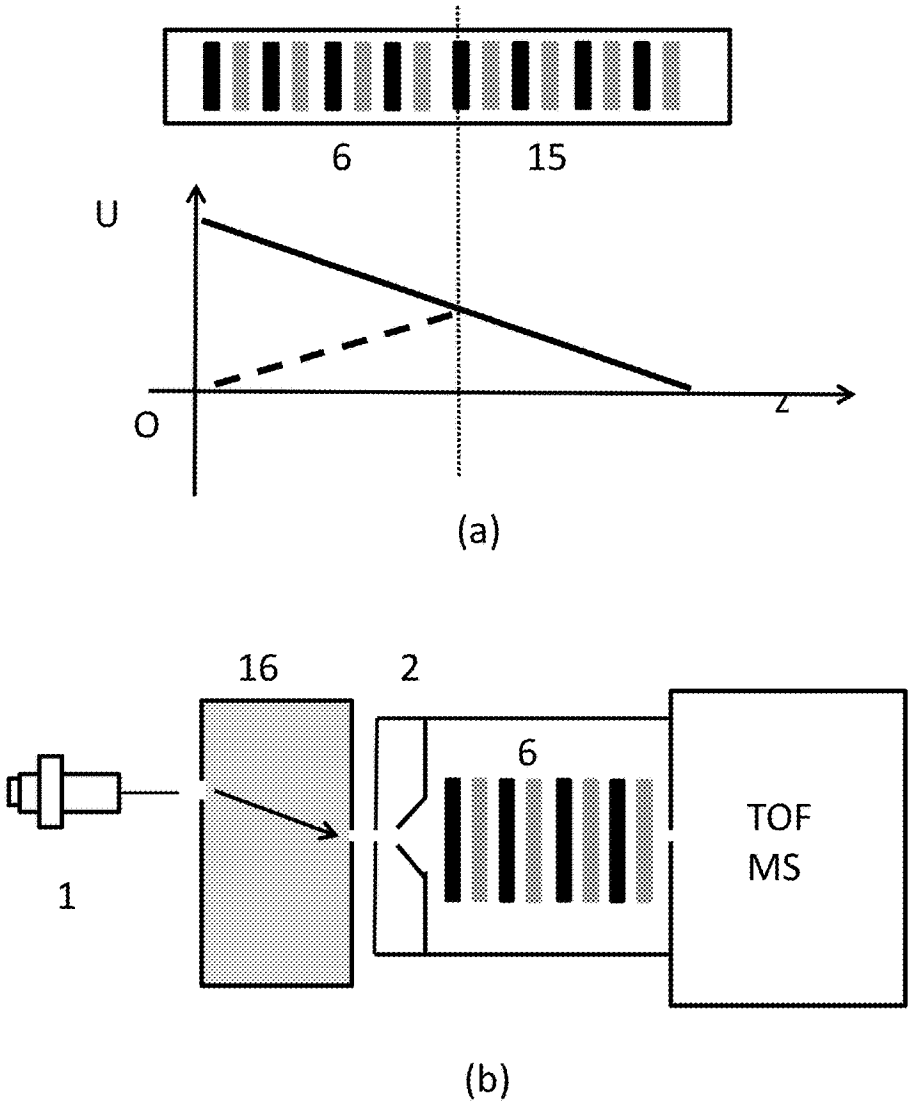
FIG. 9 is (a) a schematic diagram of a third application example of an embodiment of the present invention, and (b) a variation of the application example.

FIG. 9(*a*) and FIG. 9(*b*) provide a third application example and a variation thereof in an embodiment of the present invention. They indicate that the device according to the present invention may be used in combination with an ion mobility spectrometer type instrument or used as an ion mobility analyzer itself. For example, as shown in FIG. 9(*a*), the device 6 according to the present invention may be placed in front of an ion drift tube 15. The way to applying electric fields is as shown in FIG. 9(*a*), where an asymmetric AC field is applied at the segment 6, and a direct current electric field is applied at the segment 15. In the figure, a U-z dashed line indicates a potential distribution when the AC field is in a negative value, and a solid line indicates a distribution in a positive value. In this way, a continuous ion flow generated by an ion source is bunched, and then the ion flow enters the ion drift tube 15 in a pulsed manner for analysis. The present invention itself may also be used as an ion drift tube. However, drift distances of ions having different mobilities are different, which reduces the resolution to some extent. On the other hand, because of the "forward and turn around" motion characteristic of ions, a long drift distance may be ensured, and therefore, a good resolution can still be achieved. As a variation of the combined use of the device and the ion drift tube 15, the device 6 may also be used in combination with other type of ion mobility analyzer. For example, as shown in FIG. 9(*b*), the device is placed behind a differential ion mobility analyzer (DMA) 16. Commonly, the DMA 16 is difficult to be used in combination with the time-of-flight type instrument since the DMA emits ions continuously. By using the device 6, the DMA will be easily used in combination with the time-of-flight mass spectrometer, so that the application range of the DMA is greatly expanded. In addition, the device 6 may also be placed in front of the DMA 16. The device 6 may also be used in combination with a field asymmetric ion mobility spectrometer (FAIMS).

Figure 10:
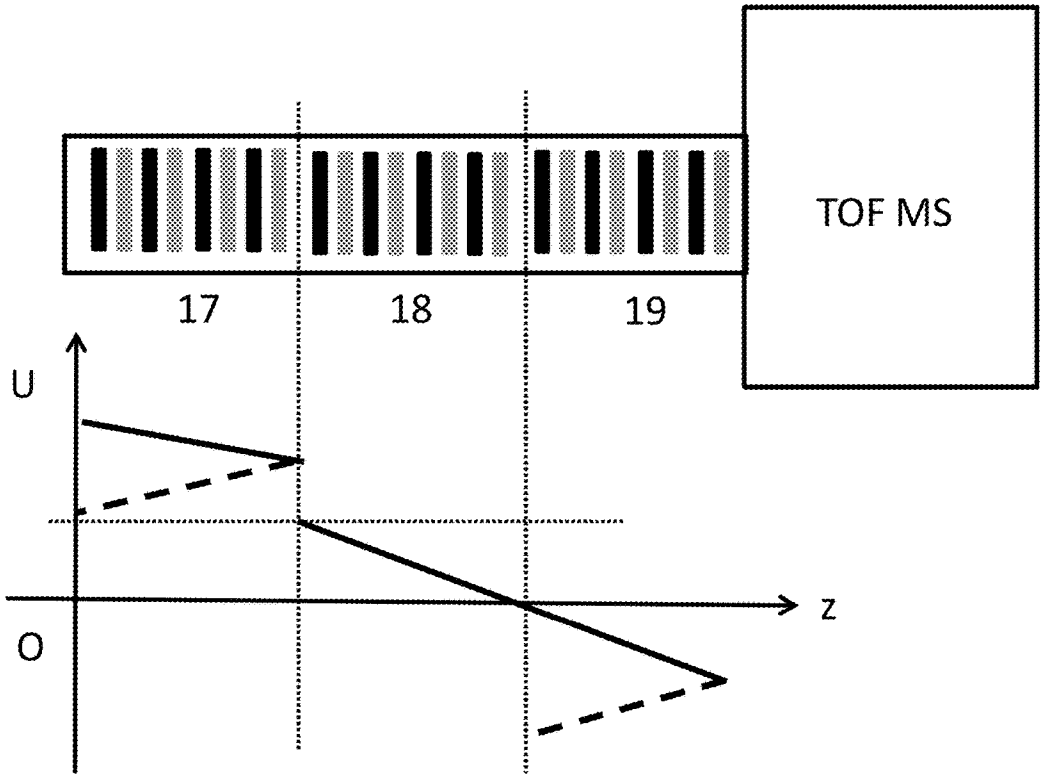
FIG. 10 is a schematic diagram of a combined application example of an embodiment of the present invention.

FIG. 10 provides a combined application manner, that is, the device is divided into three segments 17, 18 and 19, wherein the first segment 17 and the third segment 19 are both used as collision cells, and the second segment 18 is used as a drift tube. After entering the first segment 17, parent ions are fragmented to generate the first generation daughter ions, and at the same time, the daughter ions are bunched to enter the next segment 18. In this segment, the electric field intensity keeps positive, so that different daughter ions are separated in time according to the mobilities, and different daughter ions sequentially enter the third segment 19 for further dissociation to generate the second generation daughter ions. Then, the second generation daughter ions are bunched to enter the time-of-flight mass spectrometer for mass analysis. The first-generation daughter ions respectively corresponding to the second-generation daughter ions may be distinguished based on the time sequence in spectrum. This combination manner implements MS3 tandem analysis without sensitivity loss theoretically, thereby greatly improving the qualitative capability and the quantitative capability.

The above exemplarily describes the embodiments, application examples and various variation examples according to the present invention, those skilled in the art may make various combinations and substitutions on basis of the above preferred embodiments and variation examples, to obtain various variation structure, which should fall within the protective scope of the present invention. In addition, on basis of other application content of the present invention, those variations that require for minor modifications and are easy in implementation should also fall with the protective scope of the present invention.

What is claimed is:

1. An ion guiding device, comprising:

an electrode array having a group of electrodes distributed along an axis in space; and a power supply, providing voltages applied to the electrodes so as to form an asymmetric alternating current (AC) electric field substantially along the axis, wherein the AC electric field asymmetrically alternates between positive and negative along the axis to drive ions move back and forth along the axis in the direction corresponding to the AC electric field, and an integral value of a field intensity of the AC electric field to time in each AC period is not equal to zero, such that the ions move forward or backward along the axis, depending on the integral value, by merely a small distance in each period, so that the ions that are guided into the ion guiding device in a continuous or quasi-continuous flow manner are compressed and bunched after passing through the electrode array while being guided out in a pulsed manner along the axis.

2. The ion guiding device as claimed in claim 1, wherein when the integral value of the field intensity of the AC field to time in each AC period is positive, the positive ion flow is extracted from the ion guiding device; and when the integral value of the field intensity of the AC field to time in each AC period is negative, the negative ion flow is from the ion guiding device.

3. The ion guiding device as claimed in claim 1, wherein the electrode array comprises stacked-ring electrodes.

4. The ion guiding device as claimed in claim 1, wherein radio frequency (RF) voltages are applied on the electrode array to produce a multipole field.

5. The ion guiding device as claimed in claim 4, wherein the electrode array comprises segmented multipole rods along the axis.

6. The ion guiding device as claimed in claim 5, wherein the segmented multipole rods comprise a device generating an AC field along the axis.

7. The ion guiding device as claimed in claim 1, wherein the waveform of the field intensity of the AC field is a square wave.

8. The ion guiding device as claimed in claim 1, wherein the waveform of the field intensity of the AC field is a sine wave.

9. The ion guiding device as claimed in claim 1, wherein the distribution of the field intensity of the AC field along the axis is non-uniform.

10. The ion guiding device as claimed in claim 1, wherein at least part of electrodes in the electrode array are superimposed with RF voltages with different phases from each other, to provide radial confinement to the ions.

11. The ion guiding device as claimed in claim 1, wherein the electrode array is superimposed with a direct current voltage changing periodically along the axis, to provide radial confinement to the ions.

12. The ion guiding device as claimed in claim 1, wherein the number of electrodes comprised in the electrode array is greater than or equal to 2.

13. The ion guiding device as claimed in claim 1, wherein the axis is non-linear.

14. The ion guiding device as claimed in claim 1, wherein a distance between an electrode unit of the electrode array and the axis varies along the axis.

15. The ion guiding device as claimed in claim 1, wherein the ion guiding device is operably at a pressure ranging from $10^{-2}$ Pa to $10^{5}$ Pa.

16. The ion guiding device as claimed in claim 1, wherein the ion guiding device is at upstream of a time-of-flight mass analyzer, and the ion guiding device bunches the ions to enter an ion acceleration region in front of a flight tube of said time-of-flight mass analyzer in a pulsed manner.

17. The ion guiding device as claimed in claim 1, wherein the ion guiding device is at upstream of an ion trap, and the ion guiding device bunches the ions to enter said ion trap in a pulsed manner.

18. The ion guiding device as claimed in claim 1, wherein the ion guiding device is at upstream of a Fourier transform-type mass analyzer, and the ion guiding device bunches the ions to enter said mass analyzer in a pulsed manner.

19. The ion guiding device as claimed in claim 1, wherein the ion guiding device is at upstream of an ion mobility spectrometer, and the ion guiding device bunches ions to enter a drift tube of said ion mobility spectrometer in a pulsed manner.

20. The ion guiding device as claimed in claim 1, wherein the ion guiding device is at downstream of a differential ion mobility analyzer, wherein ions which are continuously emitted from said analyzer are bunched by the ion guiding device prior to be ejected in a pulsed manner.

21. The ion guiding device as claimed in claim 1, wherein the ion guiding device is a collision cell of a tandem mass spectrometer.

22. The ion guiding device as claimed in claim 1, wherein the ion guiding device is an ion mobility analyzer.

23. An ion guiding method, comprising:

providing an electrode array having a group of electrodes distributed along an axis in space; and providing voltages applied to the electrodes so as to form an asymmetric alternating current (AC) electric field substantially along the axis, wherein the AC electric field asymmetrically alternates between positive and negative along the axis to drive ions move back and forth along the axis in the direction corresponding to the AC electric field, and an integral value of a field intensity of the AC electric field to time in each AC period is not equal to zero, such that the ions move forward or backward along the axis, depending on the integral value, by merely a small distance in each period, so that the ions that are guided into the ion guiding device in a continuous or quasi-continuous flow manner are compressed and bunched after passing through the electrode array while being guided out in a pulsed manner along the axis.

24. The method as claimed in claim 23, wherein when the integral value of the field intensity of the AC field to time in each AC period is positive, the positive ion flow is extracted from the ion guiding device; and when the integral value of the field intensity of the AC field to time in each AC period is negative, the negative ion flow is extracted from the ion guiding device.

25. The method as claimed in claim 23, wherein the electrode array comprises stacked-ring electrodes.

26. The method as claimed in claim 23, wherein radio frequency (RF) voltages are applied on the electrode array to produce a multipole field.

27. The method as claimed in claim 23, wherein the waveform of the AC field is an asymmetric square wave, an asymmetric sine wave, an asymmetric triangular wave, a combination of the three waveforms, or a combination of the three waveforms and a symmetric waveform.

28. The method as claimed in claim 23, wherein at least part of electrodes in the electrode array are superimposed with RF voltages with different phases from each other, to provide radial confinement to the ions.

29. The method as claimed in claim 23, wherein the axis is non-linear.

30. The method as claimed in claim 23, wherein a distance between an electrode unit of the electrode array and the axis varies along the axis.

31. The method as claimed in claim 23, wherein the electrode array is at upstream of a time-of-flight mass analyzer prior to bunch ions to enter an ion acceleration region in front of a flight tube of said time-of-flight mass analyzer in a pulsed manner.

32. The method as claimed in claim 23, wherein the electrode array is coupled with an ion trap to bunch ions prior to enter said ion trap in a pulsed manner.

33. The method as claimed in claim 23, wherein the electrode array is coupled with a Fourier transform-type mass analyzer to bunch ions prior to enter said mass analyzer in a pulsed manner.

34. The method as claimed in claim 23, wherein the electrode array is coupled with an ion mobility spectrometer to bunch ions prior to enter a drift tube of said ion mobility spectrometer in a pulsed manner.

35. The method as claimed in claim 23, wherein the electrode array is coupled with a differential ion mobility analyzer, wherein ions which are continuously emitted from said analyzer are bunched by said electrode arrays prior to be ejected in a pulsed manner.

36. The method as claimed in claim 23, wherein the electrode array is an ion collision cell, to provide tandem mass spectrometry analysis.

37. The method as claimed in claim 23, wherein the electrode array is used as an ion mobility analyzer.

* * * * *